United States Patent [19]

Polk et al.

[11] 3,939,900

[45] Feb. 24, 1976

[54] APPARATUS FOR CONTINUOUS CASTING METAL FILAMENT ON INTERIOR OF CHILL ROLL

[75] Inventors: Donald E. Polk, Morristown; John R. Bedell, Sparta, both of N.J.

[73] Assignee: Allied Chemical Corporation, New York, N.Y.

[22] Filed: Jan. 27, 1975

[21] Appl. No.: 544,165

Related U.S. Application Data

[62] Division of Ser. No. 416,720, Nov. 16, 1973, Pat. No. 3,881,542.

[52] U.S. Cl. ..... 164/27; 164/282

[51] Int. Cl.[2] ..... B22D 11/06

[58] Field of Search ..... 164/87, 272, 276, 279, 164/282; 425/223

[56] References Cited

UNITED STATES PATENTS

| | | | |
|---|---|---|---|
| 112,054 | 2/1871 | Long | 164/87 |
| 359,348 | 3/1887 | Daniels | 164/278 X |
| 1,017,943 | 2/1912 | Oki | 164/276 X |
| 1,063,895 | 6/1913 | Staples | 164/272 X |
| 3,212,142 | 10/1965 | Moritz | 164/282 X |

FOREIGN PATENTS OR APPLICATIONS

| | | | |
|---|---|---|---|
| 1,040,498 | 8/1966 | United Kingdom | 164/87 |

*Primary Examiner*—Ronald J. Shore
*Attorney, Agent, or Firm*—Arthur J. Plantamura; David W. Collins

[57] ABSTRACT

A process and apparatus for producing continuous length shaped metal filaments by casting a stream of molten metal within a groove formed in the inner periphery of a cylindrical chill roll. The groove is flanked by a tapered opening of a material which has low thermal conductivity and which is not wetted when contacted by the molten metal. This novel technique increases the tolerance of the position in which the molten stream may be introduced into the groove while ensuring the production of an approximately rounded cross section by preventing the molten stream from spreading out of the groove.

8 Claims, 2 Drawing Figures

APPARATUS FOR CONTINUOUS CASTING METAL FILAMENT ON INTERIOR OF CHILL ROLL

This is a division of application Ser. No. 416,720, filed Nov. 16, 1973, now U.S. Pat. No. 3,881,542.

BACKGROUND OF THE INVENTION

I. Field of the Invention

This invention relates to a process and apparatus for the production of shaped continuous metallic filaments directly from the melt by casting a stream of molten metal into a quenching groove on the inside of a revolving annular chill roll, the groove being flanked by a smooth inclined surface of a material which has low thermal conductivity, is relatively non-quenching and which is not wetted by the molten metal.

II. Description of the Prior Art

Research in recent years has been directed toward the development of methods of filament formation which avoid the restrections of die drawing or rolling. One of the approaches under investigation involves free casting or direct melt spinning and concerns the formation of a free jet of molten fluid and the transformation of the jet to the solid state. This procedure may be readily employed to form filaments of polymeric materials and oxide glasses, i.e. materials having very high viscosities and low surface tension in the liquid state. In contrast, however, metals have relatively inviscid melts of high surface free energy. A cylindrical jet of such a material is inherently unstable. Its surface becomes increasingly perturbed as it issues from the nozzle until at some distance the jet breaks up into droplets. Accordingly, a process, if it is to be capable of producing continuous metal filament, must provide a favorable balance between the kinetics of jet solidification and of jet breakup.

P. Duwez, R. H. Willens and W. Klement in "Continuous Series of Metastable Solid Solution in Ag-Cu Alloys," *J. Applied Physics*, 31 (1960) 1136–7 disclose a method for the rapid quenching of metal alloys. The process disclosed by Duwez et al. comprises propelling a small liquid droplet, on the order of about 25 mg, by means of a shock wave against the inside surface of a high speed rotating copper annular chill roll or cylinder. The centrifugal force acting on the molten material insures a good thermal contact with the chill surface and the relative motion of the roll and the droplet also helps in spreading the liquid over a larger area. This spreading process leads to a thinner layer of solidified material and therefore a larger over-all thermal transfer rate.

R. Pond, Jr. and R. Maddin in "A Method of Producing Rapidly Solidified Filamentary Castings," *Trans. Met. Soc. AIME* 245 (1969) 2475–6 expands the concept which Duwez et al. employed to produce metal "splats" to encompass the production of metal filaments. Pond and Maddin disclose an apparatus comprising a small open tube furnace, a pneumatic cage which raised and lowers a graphite ejection mold and a motor-driven chill roll. To operate, the ejection mold is lowered from the furnace into the spinning roll and pressure is applied in the ejection mold which forces a stream of molten alloy through a sapphire orifice onto the inside surface of the spinning roll. The pneumatic cage subsequently pulls the ejection mold out of the chill roll, producing a spiraling specimen on the wall of the chill roll.

Since the ejection mold is pulled out of the cage during production, it is clear that this method can be used to produce only discontinuous lengths. Moreover, although the radial acceleration of the roll induces good thermal contact, it also spreads the stream into a flat filament prior to solidification. Thus, the filaments so produced are flat with blunt edges and have had maximum lengths of up to about seven meters, with thicknesses in the range of 5 to 50 microns and widths of 0.2–1.5 mm.

There is a need in the art for a simple method for the production of metal filaments, particularly metal filaments having generally round cross sections. More specifically there is a need for continuous lengths of such "round" filaments, particularly those filaments having very fine cross-sections in the range of 0.004 to 0.010 inch. Moreover, there is a need for a simple and direct method for the production of fine diameter filaments of amorphous and metastable alloys, which in many cases can only be obtained by very rapid quenching from the melt, and of metals and metal alloys which are too brittle to be produced in the normal manner.

SUMMARY OF THE INVENTION

In accordance with this invention, we have found that a wire-like metal filament can be produced directly from the melt by casting a stream of molten metal within a groove formed in the inner periphery of a cylindrical chill roll. In order to increase the tolerance of the position in which the molten stream may be introduced into the groove and to ensure the production of an approximately rounded cross-section by preventing the molten stream from spreading out of the groove, the groove is flanked by a tapered opening of a material which has low thermal conductivity and which is not wetted when contacted by the molten metal. Thus, this novel method and apparatus prevents the molten metal from spreading over the surface of the roll and very substantially decreases the precision needed in casting the molten jet into the quenching groove. The velocity and diameter of the molten jet, the frequency of rotation and radius of the chill roll, and the radius of the groove on the roll can be selected so as to give a filament having the desired cross-section. In accordance with this invention, filaments with cross-sections of as little as 0.004 to 0.010 inch are possible. Moreover, since the metal is rapidly quenched, the apparatus and method of the invention may be used to produce either amorphous or polycrystalline filaments.

The method and apparatus of the invention may readily be adapted to the simultaneous production of a plurality of filaments by incorporating a series of grooves into the quench surface and directing the flow of melt from a central heated reservoir through a corresponding series of nozzles and into the multiple grooves.

The leading end of the filament may be removed from the groove or grooves and directed to a collecting device by use of vacuum devices, doctor blades, etc. or, in the case of iron-based alloys, a radially magnetized magnetic pick-up wheel or the like could be incorporated into this apparatus. Production of continuous length filaments would be assured since there would be no need to stop production to remove the filament from the chill roll as is required in the Pond and Maddin technique.

There are a number of advantages to the use of the apparatus and method disclosed herein; the primary advantage being that this invention provides an extremely simple and direct technique for the production of fine filaments having a substantially uniform cross-section and does not require the sophisticated and precise controls which were required by the extremely sensitive melt spinning methods previously used. Further, rapid quenching of the molten metal as required in the production of totally amorphous metal filaments is possible in accordance with the present invention.

This invention thus provides a method and apparatus for the production of fine diameter filaments of polycrystalline metals and also of metastable alloys, such as amorphous metals and non-ductile or brittle alloys which are not readily formable into filaments using conventional processes.

DESCRIPTION OF THE PREFERRED EMBODIMENTS

Figure 1:
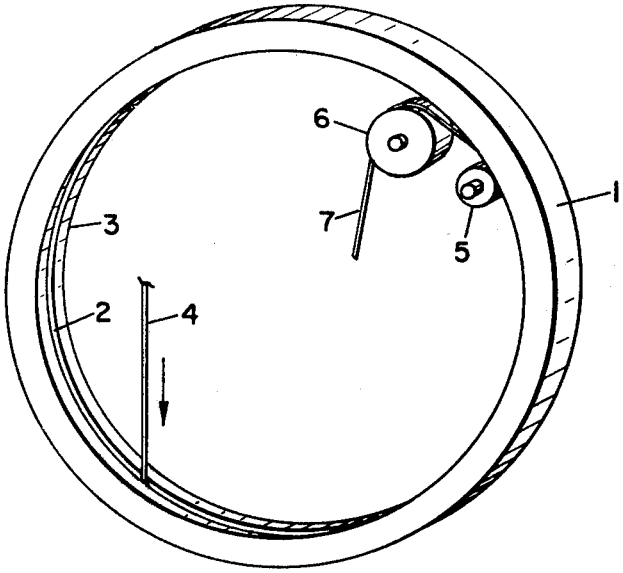
FIG. 1 represents a side view of the novel grooved cylinder of the present invention.
Figure 2:
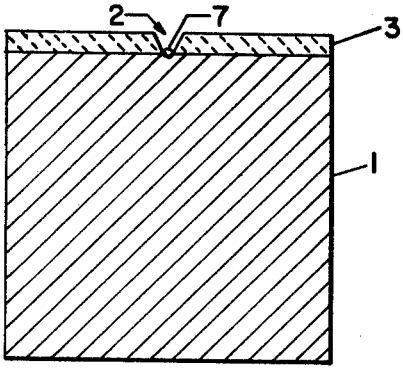
FIG. 2 shows a cross-sectional view of the cylinder clearly indicating the inclined insulating surface flanking the forming and quenching grooves.

The process and apparatus of the invention are illustrated in the attached FIGS. 1 and 2. For the purposes of illustration, we will describe an embodiment wherein a single continuous filament is produced, however, it is understood that the apparatus could be readily modified to simultaneously produce a plurality of such filaments.

The apparatus employed comprises a rotatable metal cylinder chill roll 1 having a groove 2 (or grooves) formed in the inner periphery thereof. The groove 2 is flanked by a smooth tapered opening of a relatively insulating material 3 which has low thermal conductivity and which is not wetted when contacted by the melt.

The metallic material to be spun is charged in a reaction vessel (not shown) composed of suitable heat tolerant material for the particular metal to be processed. The charge is heated, preferably in an inert atmosphere and at substantially atmospheric pressure. When the temperature of the metal is approximately 50°–100°C above the melting point, the pressure in the charged vessel is raised 5–20 psig or until a molten stream 4 is ejected through a nozzle (not shown) and cast into the groove 2 in the chill roll. It is preferred that the nozzle be tapered since tapering of the nozzle enhances jet stability.

The velocity at which the molten stream is ejected, the rotational velocity of the roll, the diameter of the ejected stream and the diameter of the groove are interrelated quantities. The preferred surface speed of the groove is in the range of 1.00 to 1.16 times the speed of the ejected molten stream. If the rotational and ejection speeds are the same, the diameter of the groove and therefore the diameter of the resulting filament should be equal to the diameter of the molten stream; if the rotational speed is about 16% greater than the ejection velocity, the groove and filament diameter should be about 4% less than the diameter of the nozzle. One of the considerations involving the velocity of ejection is the jet stability, i.e. the velocity must be sufficient to ensure a continuous, uniform jet stream yet must not be so great as to cause break-up of the stream at the point of impact with the cylinder. This jet stability varies according to alloy composition; however, in general it has been found that ejection velocities within the range of 180–260 cm/sec will result in a satisfactorily stable jet. It is then possible to adjust the spinning conditions according to the form of the solidified filament being produced.

A feature of the present invention is that by increasing the tolerance required in positioning the molten stream it is unnecessary to deliver the filament exactly into the narrow groove in the conductor material in order to produce filaments of extremely fine cross-section. However, care must be taken to deliver the molten stream somewhere within the relatively wider area defined by the non-wettable insulating material. It is preferable that the molten stream be ejected at an acute angle to the inner surface of the cylinder and in the direction of movement of the rotating roll so that the stream is "laid into" the groove with as little bending of the stream as possible. The molten stream is directed down the tapered non-conducting surface of the material 3 and into the extremely narrow groove 2 defined in the conducting or quenching substrate 1 wherein the filament is solidified. The tapered, non-conducting surface prevents the molten stream from spreading out of the groove, and the surface tension of the molten metal is sufficient to cause the filament to be formed in a relatively circular cross-sectional diameter.

The filament as it is being solidified will be carried by the rotating chill roll 1, kept in contact with the quench surface thereof by optional guide or retaining means 5 until substantially solidified and then picked up from the groove 2 and subsequently collected. The removal of the filament 7 from the groove is initiated by using a pick-up device 6 to remove the leading end of the filament. The pick-up device 6 may comprise a variety of elements: we have found that a radially magnetized magnetic pick-up means is particularly satisfactory for removing iron-base filaments; suction or vacuum-creating tubes or other devices may be used in the case of non-magnetic filament. These devices are located within the spinning apparatus at a point beyond the point of solidification of the filament. The leading end of the filament is directed from the pick-up device 6 to any conventional collection or winding mechanism (not shown).

In order to prevent the filament from falling out of the groove either before complete solidification or before pick-up, it may be necessary to incorporate a retention or a guide device 5 into the apparatus. This device is preferably in the form of a freely rotating smooth surface wheel.

In constructing the novel apparatus of the present invention, the substrate material 1 comprising the actual quench surface of the chill roll can be any metal having high thermal conductivity. This requirement is particularly applicable to the spinning of amorphous or metastable filaments. Preferred materials include beryllium copper, oxygen-free high conductivity copper, or stainless steel. The insulating or non-conducting material 3, is about $10 \times 10^{-3}$ to about $200 \times 10^{-3}$ inches in thickness, should be smooth surfaced and may comprise aluminum oxide, fired lava, zirconium oxide, vitrous carbon, zirconium titanate, chromium oxide, aluminum oxide/chromium oxide blend, calcium titanate, calcium zirconate or similar suitable material. It is to be understood that the particular insulating material employed must be chosen with respect to the metal to be cast since it is intrinsic that the insulating material not be wetted when contacted by the molten metal. To facilitate construction, a thin layer of the insulating material 3 may be coated on the interior surface of the conducting chill surface 1 by flame spreading or sputtering techniques and then the grooves or grooves can be created by machining with a laser or diamond tool. Alternatively, an insert of the insulating material may be employed. The groove 2 should be formed so that the upper opening of the groove in this insulating material is substantially larger, i.e., on the order of about 10 times larger than the conducting area of the groove wherein the fine filament is actually formed. In general, the width of the upper opening of the groove will be greater than about $10 \times 10^{-3}$ inches and the lower groove will have a radius of curvature in the range of about $2 \times 10^{-3}$ to about $12.5 \times 10^{-3}$ inch. By way of illustration, a thin surface film of ceramic approximately 0.05 inch could be flame sprayed on the inner surface of a 1 inch copper cylinder. An appropriate U-shaped diamond stylus could then be used to machine in a groove having an upper opening width of $50 \times 10^{-3}$ inch, and a groove in the copper having a radius of curvature of $4 \times 10^{-3}$ inch. Thus a filament approximately $8 \times 10^{-3}$ inch could be easily produced by directing a molten stream through the orifice of a nozzle having a diameter of about $8 \times 10^{-3}$ inches into the substantially wider $50 \times 10^{-3}$ inch area thereby assuring the production of a very fine filament with a miniumum amount of precision required for forming.

In each case, the quenching chill roll may be sufficiently cooled by virtue of its own rotation or it may be necessary to employ external means to dissipate the excess heat. Such external means may be particularly necessary when a series of filaments are produced using multiple grooves in the chill roll. Such external cooling may comprise blowing gas on the inner surface of the roll or fitting the roll with internal cooling chambers through which a fluid can be passed.

Since the reservoir in which the metal is melted is, for geometric reasons, most preferably located outside the quenching roll, it may be necessary to apply resistance or induction heating to the nozzle in order to maintain the molten metal at a sufficiently high temperature so as to prevent solidification within the nozzle.

The following examples are presented for illustration and the invention is not to be considered as limited thereto.

EXAMPLE 1

An apparatus similar to that depicted in FIGS. 1 and 2 was used to produce continuous amorphous filaments. The inner surface of a copper cylindrical chill roll of 18 inches outer diameter, 17 inches inner diameter was flame sprayed with a 0.05 inch zirconium oxide coating and a diamond stylus was used to machine a U-shaped groove having an upper opening width of $50 \times 10^{-3}$ in. and a lower radius of curvature of $2.5 \times 10^{-3}$ width. The apparatus was constructed with a rubber guide roll and a radially magnetized pick-up wheel, located about 180° from the point of impingement of the melt.

An insulated quartz crucible was charged with an ingot of an alloy composed of 38 at. % iron, 39 at. % nickel, 14 at. % phosphorus, 6 at % boron and 3 at. % aluminum. The alloy was melted in a helium atomosphere at 1,050°C and extruded into the groove through an induction heated nozzle having an orifice $5 \times 10^{-3}$ inc. in diameter directed at an angle of 30° with the cylinder surface and in the plane of the groove in the direction of rotation of the cylinder. The ejection velocity of the metal and the linear rotational velocity of the cylinder were both approximately 200 cm/sec. The stream was quenched, directed past the guide roll and the filament picked up from the groove using a magnetic wheel and wound continuously on a tension controlled winder. Upon examination using x-ray diffraction, the filament was found to be amorphous in structure.

EXAMPLE 2

An apparatus similar to that employed in Example 1 but containing a series of five U-shaped grooves having an upper surface width of 100 mils and lower radius of curvature of 9.5 mils and adapted with a vacuum producing pick-up device was used to produce multiple continuous lengths of polycrystalline wire.

A stainless steel ingot was melted to 1,550°C. in an $Al_2O_3$ crucible and ejected through a series of five induction heated nozzles each having an orifice of $10 \times 10^{-3}$ inch. The ejection velocity of the jet was about 200 cm/sec and the linear rotational velocity of the cylinder about 225 cm/sec. The filaments were quenched, picked up using a vacuum tube and collected on a series of winders. We claim:

1. In an apparatus for the production of continuous length shaped metal filaments from a molten stream wherein the filament is shaped by casting onto the inside surface of a rotating cylindrical chill roll, the improvement wherein said apparatus comprises:

a. at least one groove formed in the inner periphery of the roll, said groove being flanked by a smooth tapered surface of a thermal insulating material which has a substantially greater thermal insulating property than the chill roll and which is not wetted by the molten metal said tapered surface directing into the groove the molten metal impinged thereon; and b. means for removing the solidified shaped filaments from the groove.

2. The apparatus of claim 1 wherein a series of grooves are machined within the chill roll to allow simultaneous production of a plurality of filaments.

3. The apparatus of claim 1 wherein the means for removing the leading end of the filament is a radially magnetized magnetic pick-up wheel.

4. The apparatus of claim 1 wherein the thermal insulating material is chosen from the group consisting of aluminum oxide, fired lava, zirconium oxide, vitrous carbon, zirconium titanate, chromium oxide, calcium titanate and calcium zirconate.

5. The apparatus of claim 1 wherein a guide means is incorporated to direct the filament for recovery.

6. The apparatus of claim 1 wherein a retaining device is incorporated to ensure complete solidification of the filament.

7. The apparatus of claim 1 wherein the groove of insulating material has an upper opening greater than $10 \times 10^{-3}$ inch and a lower groove with radius of curvature within the range of $2 \times 10^{-3}$ to $12.5 \times 10^{-3}$ inch.

8. The apparatus of claim 1 wherein the non-conducting layer is $10 \times 10^{-3}$ to $200 \times 10^{-3}$ inch in thickness.

* * * * *